US007278201B2

(12) United States Patent
Szwarc et al.

(10) Patent No.: US 7,278,201 B2
(45) Date of Patent: Oct. 9, 2007

(54) METHOD OF MANUFACTURING A RESISTOR

(75) Inventors: Joseph Szwarc, Ramat-Gan (IL); Reuven Goldstein, Herzelia (IL)

(73) Assignee: Vishay Intertechnology, Inc, Malvern, PA (US)

( * ) Notice: Subject to any disclaimer, the term of this patent is extended or adjusted under 35 U.S.C. 154(b) by 304 days.

(21) Appl. No.: 10/967,883

(22) Filed: Oct. 18, 2004

(65) Prior Publication Data

US 2005/0083170 A1 Apr. 21, 2005

Related U.S. Application Data

(60) Continuation of application No. 10/304,261, filed on Nov. 25, 2002, now Pat. No. 6,892,443, which is a division of application No. 10/762,609, filed on Jan. 22, 2004.

(51) Int. Cl.
*H01C 17/00* (2006.01)

(52) U.S. Cl. ..... 29/610.1; 29/612; 29/620; 29/621; 219/121.69; 338/7; 338/195; 338/204; 338/314; 438/124

(58) Field of Classification Search ..... 29/610.1, 29/612, 620, 621; 219/121.69; 338/195, 338/314, 7, 204; 438/124
See application file for complete search history.

(56) References Cited

U.S. PATENT DOCUMENTS 3,405,381 A 10/1968 Zandman
3,824,521 A 7/1974 Horii
4,455,744 A 6/1984 Zandman
4,677,413 A 6/1987 Zandman
5,039,976 A 8/1991 Drabkin
6,171,922 B1 1/2001 Maghsoudnia
6,404,324 B1 6/2002 Wit

FOREIGN PATENT DOCUMENTS

GB 2 181 009 A 4/1987

OTHER PUBLICATIONS

New Z-Based Foil Technology Enhances Resistor Performance, Featured Technical Paper, Jul./Aug. 2002, Reaven Goldstein and Joseph Szwarc.

*Primary Examiner*—A. Dexter Tugbang
*Assistant Examiner*—Tim Phan
(74) *Attorney, Agent, or Firm*—McKee, Voorhees & Sease, P.L.C.

(57) ABSTRACT

A high precision power resistor having the improved property of reduced resistance change due to power is disclosed. The resistor includes a substrate having first and second flat surfaces and having a shape and a composition; a resistive foil having a low TCR of about 0.1 to about 1 ppm/° C. and a thickness of about 0.03 mils to about 0.7 mils cemented to one of the flat surfaces with a cement, the resistive foil having a pattern to produce a desired resistance value, the substrate having a modulus of elasticity of about $10\times10^6$ psi to about $100\times10^6$ psi and a thickness of about 0.5 mils to about 200 mils, the resistive foil, pattern, type and thickness of cement, and substrate being selected to provide a cumulative effect of reduction of resistance change due to power. The present invention also provides for a method of producing a high precision power resistor.

5 Claims, 3 Drawing Sheets

METHOD OF MANUFACTURING A RESISTOR

CROSS-REFERENCE TO RELATED APPLICATIONS

This application is a Continuation of U.S. patent application Ser. No. 10/304,261 filed on Nov. 25, 2002 now U.S. Pat. No. 6,892,443, the contents of which are hereby incorporated by reference in their entirety. See also U.S. patent application Ser. No. 10/762,609 filed Jan. 22, 2004 which is a Divisional of U.S. patent application Ser. No. 10/304,261.

BACKGROUND OF THE INVENTION

It is well known to obtain low TCR (Temperature Coefficient of Resistance) resistors. Said resistors will change very little in their resistance when subject to uniform temperature changes. For example, wirewound or thin film or foil resistors may change as little as 3 ppm/° C. In other words, if the ambient temperature changes from 25° C. to 125° C. (a 100° C. temperature difference) the resistor will change (3 ppm/° C.) (100° C.)=300 ppm ΔR/R. The resistor property of low TCR is therefore useful and desirable where high precision is required and ambient temperature changes may occur.

However, if the same resistor is subject to electric power (current) without a change in ambient temperature the resistance can also change several hundred ppm's depending on the power applied. This phenomena is sometimes described as the Joule effect or resistor self-heating. Both resistance changes due to changes in ambient temperature and resistor changes due to electric power phenomena are additive.

For applications where resistors are used as current sensors (i.e. 4 contact devices) such changes in resistance due to self-heating would, in many cases, be so significant so as to make such resistors unsuitable for accurate current sensing. To resolve this problem, one uses several resistors connected in parallel to distribute the heat due to power across the plurality of resistors so that the temperature of each resistor is reduced and the effect of self-heating is reduced. There are significant disadvantages to this approach, however, as the resulting component is larger (several resistors as opposed to a single resistor), more costly in materials, requires labor for assembly, and the component takes up more space on a printed circuit board than a single resistor. Thus, problems remain.

Therefore, it is a primary object of the present invention to improve upon the state of the art.

It is a further object of the present invention to provide a resistor with suitable properties for use as a high precision power resistor.

A still further object of the present invention is to provide a resistor suitable for use in current sensing applications.

Another object of the present invention is to provide a resistor that demonstrates only small changes in resistance due to power.

Yet another object of the present invention is to provide an improved resistor designed to take into account properties of the resistive foil adhesive cement and substrate to provide a cumulative effect of reduction of resistance change due to power.

A further object of the present invention is to provide a resistor that can be manufactured on a large scale and at a reasonable cost.

One or more of these and/or other objects, features, or advantages of the present invention will become apparent from the Specification and claims that follow.

SUMMARY OF THE INVENTION

The present invention provides for a high precision power resistor. The power induced resistance change of the resistor is substantially reduced. To do so, the present invention takes into account construction of the resistor, properties of the cement, the shape and type of substrate, the resistor foil, and the pattern design for the resistor foil.

According to one aspect of the invention, a resistor is provided that includes a substrate having first and second flat surfaces and having a shape and a composition. The resistor also includes a resistive foil having a low TCR of about 0.1 to about 2 ppm/° C. and a thickness of about 0.03 mils to about 0.7 mils cemented to one of the flat surfaces of the substrate with the cement. The resistive foil has a pattern to produce a desired resistance value. The substrate also has a modulus of elasticity of about $10\times10^6$ psi to about $100\times10^6$ psi and a thickness of about 0.5 mils to about 200 mils. The resistive foil, pattern, cement and substrate are selected to provide a cumulative effect of reduction of resistance change due to power.

According to another aspect of the present invention, a method for producing a resistor is disclosed. The method includes cementing a first resistive foil and a second resistive foil to opposite surfaces of a substrate, the first and second foils patterned to have approximately equal resistance values, interconnecting the first and second resistive foils to provide approximately equal power dissipation on the first and second surfaces of the substrate, thereby reducing temperature gradients across the substrate, preventing bending of the substrate, and avoiding resistance change due to bending of the substrate.

DETAILED DESCRIPTION OF THE INVENTION

Figure 1:
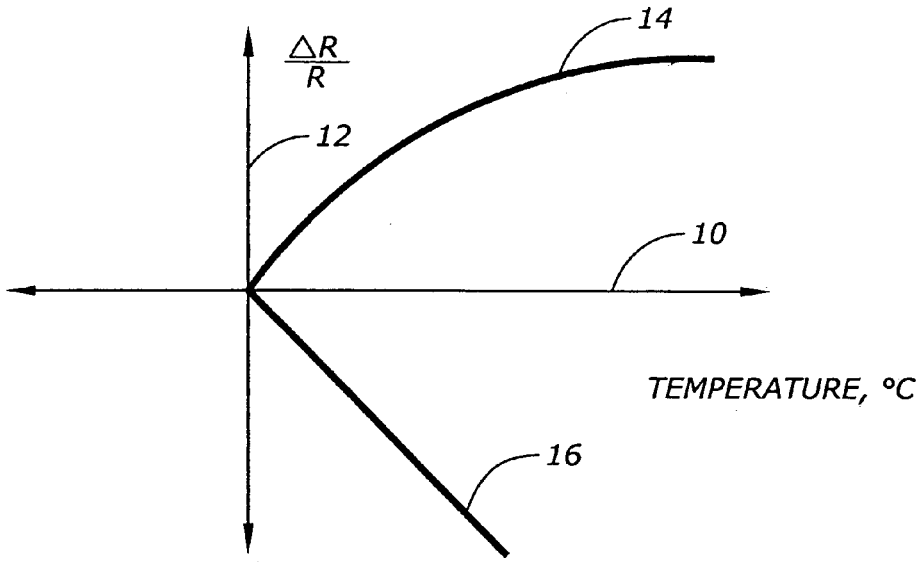
FIG. 1 is a graph showing change in resistance versus temperature for both foil before cementing to a substrate and change in resistance due to stress after cementing the foil to a substrate.
Figure 2:
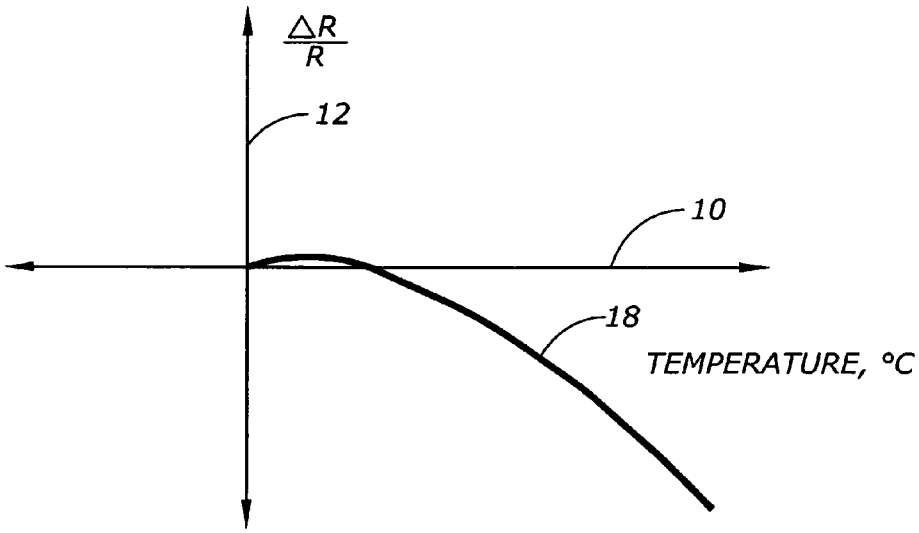
FIG. 2 is a graph showing change in resistance versus temperature for the cumulative effect of the foil and the stress after cementing the foil.

A resistor with a very low TCR (ambient temperature conditions) can be obtained by using a resistive foil with an inherent TCR such that it essentially balances the ΔR/R induced by stress when the foil is cemented to a substrate with a different coefficient of thermal expansion as the foil. The basic phenomena is shown in FIGS. 1 and 2. In addition, relevant discussion is provided in U.S. Pat. No. 4,677,413 to Zandman and Szwarc, herein incorporated by reference in its entirety.

FIG. 1 provides a graph showing a change in resistance versus temperature for both foil before cementing to a substrate 14 and change in resistance due to stress after cementing the foil to a substrate 16. As shown in FIG. 1, the temperature axis 10 and the ΔR/R axis 12 are shown. The curve 14 represents change in resistance versus temperature for the foil before cementing to a substrate. As shown, the change in resistance increases in a nonlinear fashion as a function of temperature. The linear relationship 16 is also shown for changes in resistance due to stress after the foil has been cemented to a substrate. As shown in FIG. 1, as the temperature increases, the resistance decreases. Both the changes in resistance of the foil and changes in resistance due to stress occur simultaneously when temperature changes.

FIG. 2 is a graph showing change in resistance versus temperature for the cumulative effect of the foil and the stress after cementing the foil to the substrate. In FIG. 2, the cumulative effect is indicated by reference numeral 18. The effect of the change in resistance due to temperature changes of the foil and the change in resistance due to stress after cementing the foil to the substrate are offsetting to some degree. Thus, the resulting effects can be used to decrease the resistance changes due to temperature changes. In particular note the area near the crossing of axis 12 and 10 is relatively flat and close to 0. Complete zero is very difficult to obtain because of non-linearity of curve 14 in FIG. 1.

A resistor with a very low TCR can be obtained with many types of foil, many substrate thicknesses, many substrate materials, many types of cements and cement thickness, however such a resistor will show substantial changes in resistance when subject to electric power as opposed to only ambient temperature changes. However, if the cement type and thickness, foil type and its inherent TCR and substrate type and shape and the geometry of pattern of the foil resistive element are chosen very carefully the power induced resistance change can be reduced very substantially as discovered herein.

What the present inventors have discovered is the ability to substantially influence resistance change due to power by the selection of the cement, shape and type of substrate and pattern design of the resistor foil. When power is applied to the foil it produces a higher temperature than the one in the substrate. This temperature differential across the thickness of substrate produces bending in the substrate. Such bending amount also depends on the heat transmissivity of the cement and the cement's thickness. Furthermore, if the pattern is made with longitudinal and transverse strands the strain induced by bending can be decreased by the strain effect of Poisson's ratio in certain shapes of substrate depending on it's ratio of width to thickness. Poisson's ratio is the ratio of longitudinal strain to transverse strain.

The inventors have discovered that if a proper balance is made to account for all these factors a resistor can be constructed which will show a much better performance than other power resistors. The resistor can get hot and yet it will show only very small changes in resistance due to power. This is a very significant advantage over prior art resistors.

Figure 3:
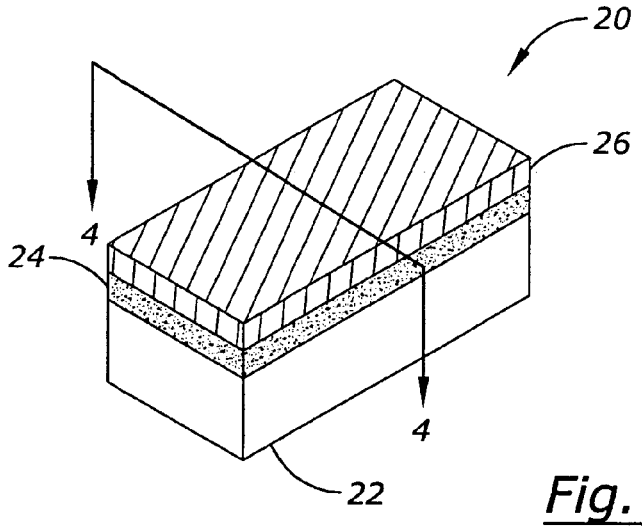
FIG. 3 is a perspective view of one embodiment of a resistor according to the present invention.
Figure 4:
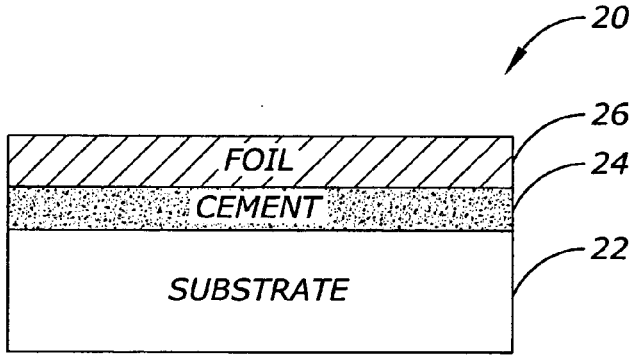
FIG. 4 is a cross-section of one embodiment of a resistor according to the present invention.
Figure 5:
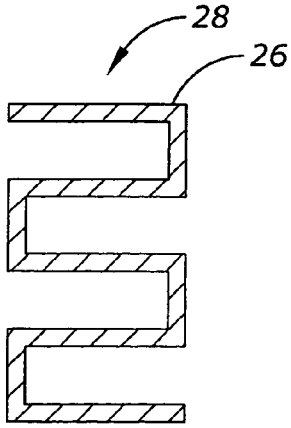
FIG. 5 is a diagram showing one embodiment of a foil pattern according to the present invention.

FIGS. 3 through 5 illustrate one resistor according to the present invention. FIG. 3 illustrates resistor 20. The resistor 20 includes an alumina substrate 22 having a length, a width, and a thickness. A resistive foil 26 of Ni/Cr of 0.100 mils in thickness and having a TCR of 0.2 ppm/° C. is cemented to the substrate 22 with an epoxy cement 24 having a modulus of elasticity of 450.000 psi and a thickness of 0.5 mils. When subject to one watt power, the resistor has a change in resistance of less than 30 ppm. The same type resistor under same conditions where the cement is of different thickness, and the TCR is 2 ppm/° C., will change resistance by 300 ppm or more.

The substrate 22 of the resistor 20 has first and second flat surfaces. The substrate has a shape and a material composition. The resistive foil preferably has a thickness of about 0.03 mils to about 0.5 mils and a TCR of about 0.1 to about 1 ppm/° C. when cemented to one of the flat surfaces with a cement. The resistive foil 26 has a pattern selected to produce a desired resistance value. The foil pattern can be made with longitudinal and transverse strands. The substrate 22 preferably has a modulus of elasticity of about $10\times10^6$ psi to about $100\times10^6$ psi and a thickness of about 0.5 mils to about 200 mils. The resistive foil, pattern, cement and substrate being chosen to provide a cumulative effect of reduction of resistance change due to power. The parameters are preferably chosen so that the resistance change of the resistor due to power will only be a small fraction (25% or less) of what it would have changed if the same resistance foil was used but it was with a TCR of more than 1 ppm/° C. and cemented to the substrate with different geometric and physical characteristics of the cement, pattern and substrate.

The parameters such as the shape of the substrate, the composition of the substrate, the thickness of the substrate, the TCR of the resistive foil, the type of cement, the heat transmissivity of the cement, and the thickness of the cement are also preferably selected to provide the cumulative effect of reduction of resistance change due to power.

It is to be understood that further assembly of the resistor 20 will proceed in accordance with techniques which are generally known in the art. Such subsequent steps could include connecting leads or contacts (not shown), adding protective materials, or other known steps that may be appropriate for a particular application.

The present invention contemplates that other types of substrates can be used of various shape compositions and thicknesses. The composition of alumina is simply one convenient type of substrate. Similarly, the resistance foil can be of any number of materials. Ni/Cr is simply one common and expedient selection. The present invention also contemplates that various types of cement, epoxy or otherwise, can also be used.

Figure 6:
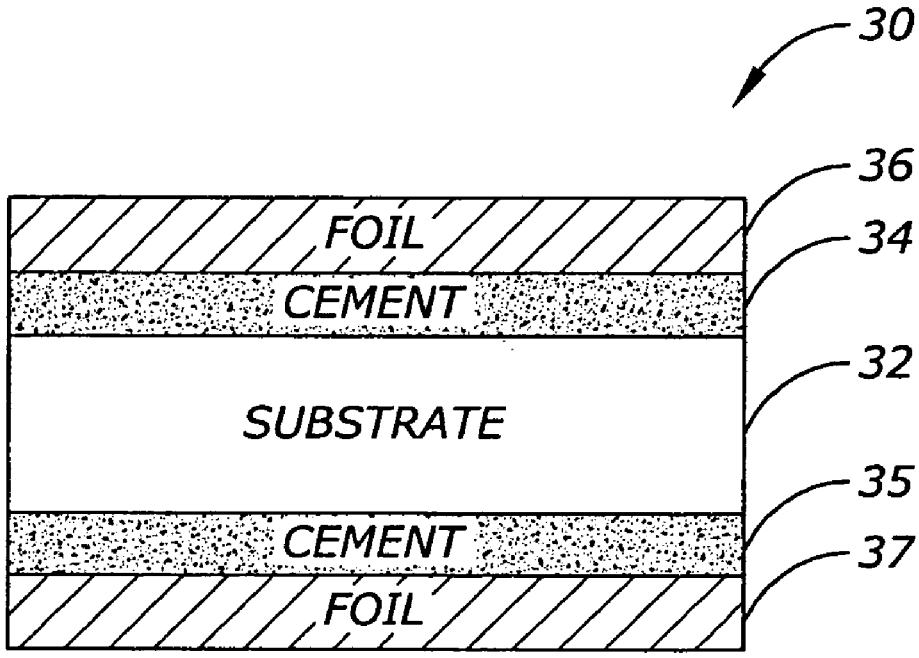
FIG. 6 is a cross-section of the second embodiment of a resistor according to the present invention, illustrating an alternative method of achieving a resistor with a reduced power coefficient of resistance.

A second embodiment of the present invention is illustrated in FIG. 6. Here the resistor 30 is constructed such that foil 36 is cemented on a first surface of the substrate 32 and a second resistive foil 37 on an opposite surface of the substrate 32.

The two foils (36 and 37) are etched in a pattern forming similar or approximately equal resistance values and are interconnected, in parallel or in series. When power is applied to the resistor, the two opposite surfaces are heated equally. This results in a minimal heat flow across the substrate as there is no temperature differential across the substrate's thickness and its bending is prevented. This second embodiment of FIG. 6 involves higher manufacturing costs compared to the first embodiment. Thus, a high precision power resistor has been disclosed that provides advantages over the state of the art.

What is claimed is:

1. A method of manufacturing a resistor with suitable properties for use as a high precision power resistor comprising:

providing a substrate having a modulus of elasticity of about $10\times10^6$ psi to about $100\times10^6$ psi and a thickness of about 0.5 mils to about 200 mils, the substrate shape and substrate type selected to contribute to a cumulative effect of reduction of resistance change due to power;

providing a first resistive foil having a low TCR of about 0.1 to about 1 ppm/° C. and a thickness of about 0.03 mils to about 0.7 mils, the first resistive foil having a foil type, a pattern, and an inherent temperature coefficient of resistance selected to contribute to a cumulative effect of reduction of resistance change due to power;

cementing the first resistive foil to a first surface of the substrate with a cement having a cement type and a cement thickness selected to contribute to a cumulative effect of reduction of resistance change due to power by controlling effects of a temperature differential across the thickness of the substrate created by applying power to the first resistive foil.

2. The method of claim 1 further comprising cementing a second resistive foil having a low TCR of about 0.1 to about 1 ppm/° C. and a thickness of about 0.03 mils to about 0.7 mils to a second surface of the substrate opposite the first surface, the first and second resistive foils patterned to have approximately equal resistance value.

3. The method of claim 2 further comprising interconnecting the first resistive foil and the second resistive foil to provide approximately equal power dissipation on the first and second surfaces thereby reducing temperature gradients across the substrate, preventing bending of the substrate, and avoiding resistance change due to bending.

4. A method of manufacturing a resistor comprising:

providing a ceramic substrate having a modulus of elasticity of about $10\times10^6$ psi to about $100\times10^6$ psi and a thickness of about 0.5 mils to about 200 mils, the ceramic substrate selected to contribute to a cumulative effect of reduction of resistance change due to power;

providing a first resistive foil having a low TCR of about 0.1 to about 1 ppm/° C. and a thickness of about 0.03 mils to about 0.7 mils, the first resistive foil selected to contribute to a cumulative effect of reduction of resistance change due to power; and cementing the first resistive foil to a first surface of the ceramic substrate with a cement selected to contribute to a cumulative effect of reduction of resistance change due to power by controlling effects of a temperature differential across the thickness of the substrate created by applying power to the first resistive foil.

5. A method of manufacturing a resistor with suitable properties for use as a high precision power resistor, comprising:

determining a substrate, a resistive foil, a cement, and a resistive foil pattern to use to contribute to a cumulative effect of reduction of resistance change due to power by controlling effects of a temperature differential across the thickness of the substrate created by applying power to the first resistive foil;

wherein the substrate has a module of elasticity of between about $10\times10^6$ and $100\times10^6$ psi and a thickness of between about 0.5 mils to about 200 mils;

wherein the resistive foil has a low TCR of between about 0.1 to about 1 ppm/° C. and a thickness between about 0.03 mils to about 0.7 mils;

cementing the resistive foil to the substrate with the cement so as to produce a resistor for use as a high precision power resistor.

* * * * *